United States Patent [19]

Ohshima et al.

[11] Patent Number: 4,475,917

[45] Date of Patent: Oct. 9, 1984

[54] PROCESS FOR MODIFYING REGENERATED CELLULOSE FIBER

[75] Inventors: Takeo Ohshima, Moriyama; Shigeki Ohtani, Ibaraki, both of Japan

[73] Assignee: Asahi Kasei Kogyo Kabushiki Kaisha, Osaka, Japan

[21] Appl. No.: 420,753

[22] Filed: Sep. 20, 1982

[30] Foreign Application Priority Data

| | | | |
|---|---|---|---|
| Sep. 24, 1981 | [JP] | Japan | 56-149349 |
| Sep. 28, 1981 | [JP] | Japan | 56-152002 |
| Feb. 2, 1982 | [JP] | Japan | 57-14389 |

[51] Int. Cl.[3] ..... D06M 1/02

[52] U.S. Cl. ..... 8/127; 8/116 R; 8/125

[58] Field of Search ..... 8/125, 127

[56] References Cited

U.S. PATENT DOCUMENTS

| | | | |
|---|---|---|---|
| 1,998,551 | 4/1935 | Mahn | 8/125 |
| 2,549,713 | 4/1951 | Seiberlich | 8/127 |
| 3,347,963 | 10/1967 | Estes et al. | 264/546 |
| 3,406,006 | 10/1968 | Lindberg et al. | 8/125 |
| 3,511,591 | 5/1970 | Webb | 8/116 R |
| 3,560,140 | 2/1971 | Gailey | 8/125 |
| 3,915,632 | 10/1975 | Troope et al. | 8/125 |
| 4,106,902 | 8/1978 | Aitken et al. | 8/125 |
| 4,199,319 | 4/1980 | Lifentsev et al. . | |
| 4,425,131 | 1/1984 | Webb et al. | 8/125 |

FOREIGN PATENT DOCUMENTS

| | | |
|---|---|---|
| 1084612 | 9/1967 | United Kingdom . |
| 1136417 | 12/1968 | United Kingdom . |
| 1141016 | 1/1969 | United Kingdom . |

OTHER PUBLICATIONS

Textile Research Journal, vol. 44, No. 9, Sep. 1974, pp. 680–686, Textile Research Institute, Princeton, NJ (USA) M. Lewin et al.: "The Role of Liquid Ammonia in Functional Textile Finishes".

Textile Chemist and Colorist, vol. 9, No. 10, Oct. 1977, pp. 33–35, Assn. of Textile Chemist & Colorist, Research Triangle NC (USA); B. J. Trask et al.: "Liquid Ammonia Stabilization of Cotton Denim".

*Primary Examiner*—Maria Parrish Tungol

*Attorney, Agent, or Firm*—Sprung Horn Kramer & Woods

[57] ABSTRACT

A process for producing a regenerated cellulose fiber having a good hand and a good shrink resistance characterized by attaching a liquid not readily soluble in liquid ammonia and adsorbable on regenerated cellulose fiber to the surface of regenerated cellulose fiber or attaching a polymer to the surface of regenerated cellulose fiber in the form of a film or not carrying out the surface treatment mentioned above, and adjusting the moisture content of said regenerated cellulose fiber to 5% or more based on the absolute dry weight of said fiber, and thereafter impregnating said regenerated cellulose fiber with liquid ammonia, and subsequently removing the ammonia from the regenerated cellulose fiber.

14 Claims, 4 Drawing Figures

PROCESS FOR MODIFYING REGENERATED CELLULOSE FIBER

Figure 1:
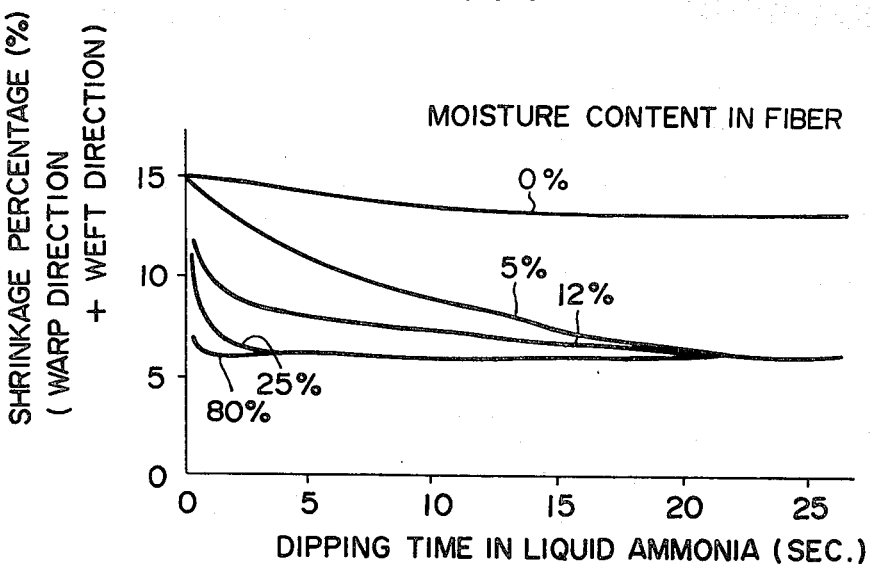

This invention relates to a process for producing a regenerated cellulose fiber which is soft and excellent in dimensional stability to water. More particularly, this invention relates to a process for improving regenerated cellulose fiber with liquid ammonia by which dimensional stability of the regenerated cellulose to water can be improved without deteriorating softness and elongation at break of regenerated cellulose fiber and, in case of cloth, its tear strength.

Though regenerated cellulose fiber is characterized by its excellent moisture absorbability and water absorbability, its high antistatic property and the easiness to remove stains therefrom, it has a defect that it is poor in dimensional stability to water, namely it shrinks after washing and it becomes creased after washing.

In order that regenerated cellulose fiber can be used as a clothing material, the above-mentioned defect must be overcome.

Through many years, a number of studies have been conducted for improving the dimensional stability to water, namely for lessening shrinkage percentage, of cellulosic fibers including natural cellulose fiber typified by cotton. As one example of such studies, the treatment of cellulose fiber with liquid ammonia can be referred to.

Such a treatment is mentioned in British Pat. No. 1,136,417 (1966) and British Pat. No. 1,084,612 (1967) as mercerization of cotton with liquid ammonia. However, the present inventors have found that, if this process is applied to regenerated cellulose fiber, softness of the regenerated cellulose fiber is deteriorated. Thus, if this process is applied to regenerated cellulose fiber, the surface of regenerated cellulose fiber is swollen to such an extent as to be nearly a dissolution due to the strong swelling action of liquid ammonia on cellulose, and single yarns readily become adhered to one another. This state is retained even after the liquid ammonia has been removed from the fiber. Accordingly, in yarns and cloths which are assemblies of single yarns, slippage and movement between the internal single yarns are suppressed, so that softness of the yarn or cloth is markedly deteriorated. As above, mercerization of regenerated cellulose fiber obviously lacks practicability.

On the other hand, if cotton is treated with liquid ammonia, swelling of its surface layer part is suppressed and adhesion among single fibers does not occur and therefore its hand is not deteriorated, because cotton has a dense secondary wall structure in the fiber surface.

The present inventors have studied the difference in the state of adhesion between cotton and regenerated cellulose fiber occurring in the mercerization with liquid ammonia. Based on the results of the study, the present inventors have invented a method for preventing the adhesion of regenerated cellulose fibers.

As mentioned above, regenerated cellulose fiber is swollen by liquid ammonia, and its single yarns readily become susceptible to adhesion. If single yarns in such a state undergo a light pressing, such as tension given to fiber, compression given by a mangle roller or the like, contact with a turning roll, and so on, they are readily deteriorated, so that yarns or cloths lose their softness to become rigid.

In order to avoid it, the mutual contact of single yarns must be prevented. The present inventors have studied the method for preventing the mutual contact among single yarns to discover a method which comprises covering the surface of single yarns with a liquid substance not readily soluble with liquid ammonia or a film-formable polymeric substance before the treatment with liquid ammonia, and adjusting the moisture content of the yarns to a specific range and then treating the yarns with liquid ammonia. That is, by this method, single yarns of regenerated cellulose are previously coated with a substance not readily soluble in liquid ammonia and adsorbable on regenerated cellulose or with a film-formable polymeric substance and the moisture content of the fiber is adjusted to a specific range and then the regenerated cellulose is impregnated with liquid ammonia, whereby the mutual contact of the single yarns of regenerated cellulose can be prevented even if they are swollen.

According to this invention, regenerated cellulose fiber can be treated with liquid ammonia without substantially deteriorating its softness and, in case of cloth, its tear strength.

Further, the present inventors have conducted an elaborated study on the effect of the liquid ammonia treatment for improving the dimensional stability of cellulose fiber to water. As the result, there is discovered a surprising fact hitherto unknown that natural cellulose fiber and regenerated fiber are greatly different in the effect given by liquid ammonia, so that the dimensional stability of regenerated cellulose fiber to water cannot be sufficiently improved by the hitherto known process.

For example, as the treatment of cellulose fiber with liquid ammonia, the process of U.S. Pat. No. 1,998,551 can be referred to. In this patent specification, a process for treating cellulose fiber without tension or with a very weak tension is mentioned. However, the regenerated cellulose fiber treated by this process is insufficient in dimensional stability to water.

In U.S. Pat. No. 3,511,591 and U.S. Pat. No. 3,347,963, the process of liquid ammonia treatment is employed as a method for preliminarily shrinking fiber. However, the dimensional stability of regenerated cellulose fiber to water cannot be sufficiently improved by this method.

In U.S. Pat. No. 3,406,006, there is mentioned a process for treating cellulose fiber with liquid ammonia for the purpose of improving its dimensional stability to water. However, this still cannot be a process for improving dimensional stability of regenerated cellulose fiber sufficiently.

In U.S. Pat. No. 3,560,140, Japanese Patent Kokai (Laid-Open) No. 157,700/75 and Japanese Patent Kokai No. 48,298/75, there are similarly mentioned processes for treating cellulose fiber with liquid ammonia. However, none of these processes can be a means for sufficiently improving the dimensional stability of regenerated cellulose fiber to water.

Thus, processes which comprise impregnating cellulose fiber with liquid ammonia and thereby treating the cellulose fiber cannot exhibit a sufficient effect for overcoming the important fault of regenerated cellulose, i.e. its deficiency in dimensional stability to water, even though these processes are effective for increasing the strength of natural cellulose fiber (cotton), improving its dimensional stability, increasing its gloss and improving its dyeability.

Hitherto, it has often been considered that a process known as a processing technique for improving the performances of natural cellulose fiber is effectively applicable also to regenerated cellulose fiber. However, natural cellulose fiber and regenerated cellulose fiber are remarkably different from each other in super molecular structure. For example, if crystal form of cellulose in fiber is analyzed by means of X-ray diffraction, natural cellulose fiber shows a crystal form called "cellulose [I]", while regenerated cellulose shows a crystal form called "cellulose [II]". Further, size of crystal in natural cellulose fiber is about 50–60 angstroms, while that in regenerated cellulose is about 40 angstroms. As above, natural cellulose fiber and regenerated cellulose fiber are different in the internal fundamental super molecular structure, and therefore it is naturally considered that they will be different in other structures, such as the structure of amorphous part, too.

Accordingly, in the modification of the super molecular structure of cellulose fiber, natural cellulose fiber and regenerated cellulose fiber cannot be expected to give the same effects and results, so far as they are treated under the same conditions. The treatment of cellulose fiber with liquid ammonia is also in the same situation as above.

In the treatment of cellulose fiber with liquid ammonia, the hydrogen bonds in the fiber are cleaved by ammonia and thereby the fiber is swollen and the residual strain in the fiber are removed and then the ammonia is removed from the fiber, by which the hydrogen bonds are regenerated and the fiber is stabilized. Accordingly, in this treatment, the extent of removing the residual strain and the period of time necessary for removing residual strain are important. Natural cellulose fiber and regenerated cellulose fiber are different from each other in the extent of swelling by liquid ammonia and the period of time necessary for the swelling, and therefore they are obviously different in the influence on super molecular structure brought about by liquid ammonia. For example, when natural cellulose fiber having a crystal form of cellulose [I] is treated with liquid ammonia, the crystal form changes to cellulose [III]-I. On the other hand, when regenerated cellulose which has a crystal form of cellulose [II] is treated with liquid ammonia, the crystal form changes to cellulose [III]-II. Further, when they are treated in hot water at 100° C. for 1–8 hours, cellulose [III]-I transforms to cellulose [I] while cellulose [III]-II does not transform to cellulose [II]. Thus, natural cellulose and regenerated cellulose fibers show different changes even if they are subjected to the same treatment, so that they cannot be regarded as similarly behaving substances in such treatments.

The present inventors have studied a process for improving the dimensional stability of regenerated cellulose to water by a treatment with liquid ammonia.

As a result, the inventors have succeeded in enhancing the effect of liquid ammonia treatment to a great extent by beforehand controlling the moisture content in fiber before treating the regenerated cellulose fiber with liquid ammonia. Thus, this invention provides a process for producing a regenerated cellulose fiber excellent in dimensional stability by treating regenerated cellulose fiber with liquid ammonia characterized in that, before impregnating the regenerated cellulose fiber with liquid ammonia, 5% by weight or more of water, based on the absolute dry weight of fiber, is previously let exist in the fiber. According to this invention, "improvement of treatment effect" and "shortening of treatment time" are possible.

According to this invention, a sufficient dimensional stability to water can be given to regenerated cellulose fiber and the period of time necessary for giving it can be shortened without deteriorating the advantages of the hitherto known techniques for treating cellulose fiber with liquid ammonia (for example, decrease in fiber strength and deterioration caused by treatment, no change in chemical structure of fiber, etc.).

Thus, according to this invention, the regenerated cellulose treated is sufficiently improved in "dimensional stability to water" of which deficiency is one of the important faults of generated cellulose, and the excellent properties of regenerated cellulose fiber (water-absorbability, moisture-absorbability, antistatic property, strength, elongation, etc.) are not deteriorated.

The characteristic feature of this invention is quite clear and definite as compared with that of prior technique (resin treatment) well known as a method for improving the dimensional stability of regenerated cellulose fiber to water. Thus, resin treatment is a method for improving dimensional stability by producing cross-linking among the molecules of cellulose fiber and thereby stopping the movement of molecules. By this method the cellulose fiber becomes rigid and brittle even though its dimensional stability to water is improved, and therefore there appears a new disadvantage such as a decrease in flexing abrasion resistance which is undesirable as clothing material.

This invention comprises impregnating liquid ammonia into regenerated cellulose fiber and thereafter removing the ammonia from the fiber. Therefore, no new chemical structure is formed in the fiber. Though the fiber is improved in dimensional stability to water, it is composed only of pure cellulose and is different from resin-treated fiber in that it does not become rigid nor brittle and the textile produced therefrom shows no decrease in flexing abrasion resistance.

As stated above, according to this invention, the dimensional stability of regenerated cellulose fiber to water can be improved without deteriorating the softness of regenerated cellulose fiber nor lowering tear strength and elongation at break.

Next, this invention will be illustrated in detail.

The regenerated cellulose fibers usable in the process of this invention include viscose rayon (including polynosic rayon) and cuprammonium rayon. The form of fiber may be any of cotton-like form, spun yarn form, filament form and cloth form, and the effect of this invention does not vary depending on the form of fiber. The fiber may also be union yarn, union fabric or mixed fabric with other kinds of fibers, so far as the characteristic feature of the regenerated cellulose fiber is not substantially deteriorated. An allowable limit in the amount of said other kinds of fibers used in combination with regenerated cellulose fiber is typically 50% by weight or less based on the total weight of all fibers.

As said liquid not readily soluble in liquid ammonia and adsorbable on regenerated cellulose fiber which can be used in the process of this invention prior to the impregnation with liquid ammonia, aliphatic and aromatic hydrocarbons, fatty oils and surfactants can be referred to, among which those keeping liquid at room temperature are preferable. The term "not readily soluble in liquid ammonia" used herein means that solubility at −50° C. is 10 g or less in 100 g of liquid ammonia. The term "adsorbable on regenerated cellulose fiber"

means that the contact angle formed between liquid and regenerated cellulose fiber is 110° or less.

Preferably, the amount of said liquid adhering to fiber is in the range of 5–15% by weight based on the weight of fiber. If it is less than 5% by weight, the adhesion occurring on the surface of single yarns cannot be prevented sufficiently. If it exceeds 15% by weight, the adhering liquid obstructs the impregnation of liquid ammonia into fiber so that the effect of modification can be unsatisfactory.

As examples of the liquid adsorbable on regenerated cellulose fiber satisfying the above-mentioned conditions, the following can be referred to: aliphatic and aromatic hydrocarbons such as pentane, hexane, heptane, octane, nonane, decane, undecane, dodecane, tridecane, benzene, toluene, xylene, mesitylene, p-cymene and the like; fatty oils including drying oils such as sardine oil, herring oil, lineseed oil and the like, semi-drying oils such as chrysalis oil, sei whale oil, rapeseed oil, cottonseed oil, sesame oil, soybean oil and the like and non-drying oils such as spermaceti, whale oil, whale brain oil, castor oil, tsubaki oil, olive oil and the like; anionic surfactants such as fatty acid salts, alkyl sulfuric ester salts, alkylbenzene-sulfonates, alkylnaphthalene-sulfonates, dialkylsulfosuccinic ester salts, alkyl phosphoric ester salts, naphthalenesulfonic acid-formaldehyde condensate, polyoxy sulfuric ester salts and the like; nonionic surfactants such as polyoxyethylene alkyl ether, polyoxyethylene alkylphenol ether, polyoxyethylene fatty acid esters, sorbitan fatty acid esters, polyoxyethylene-sorbitan fatty acid esters, polyoxyethylene laurylamine, glycerin fatty acid ester, oxyethylene-oxypropylene block polymer and the like; cationic surfactants such as alkylamine salts, quaternary ammonium salts and the like; and amphoteric surfactants such as alkylbetaine and the like.

As the substance to be attached to the surface of regenerated cellulose fiber in the form of a film (hereinafter, it is referred to as "film-formable substance"), a polymer having a molecular weight of 10,000 or more can be referred to. If its molecular weight is less than 10,000, film is difficult to form. Preferably, said polymer is attached to fiber in an amount ranging from 0.5% by weight to 10% by weight based on the absolute dry weight of the fiber. If its amount is less than 0.5% by weight, the adhesion of the surface of single yarns cannot sufficiently be prevented. If it exceeds 10% by weight, the polymer disturbs the impregnation of liquid ammonia into fiber, so that a sufficient effect of modification cannot be achieved.

As said polymers, water-soluble polymers and water-dispersible polymers can be used. Examples of such water-soluble polymers include polyvinyl alcohol, carboxymethyl cellulose, methyl cellulose, hydroxyethyl cellulose, starch, dialdehyde-starch, sodium alginate, polyacrylic acid, polyacrylamide, polyvinyl pyrrolidone, tragacanth gum, British gum, gum arabic and the like. As said water dispersible polymers, polyethylene emulsion, ethylene-vinyl acetate copolymer, polyacrylic esters and their derivatives can be referred to.

As the method for impregnating the liquid not readily soluble in liquid ammonia and adsorbable on regenerated cellulose fiber into regenerated cellulose fiber, the method of attaching and impregnating the liquid by spraying, coating, immersion or the like can be referred to. The method for attaching the polymer to regenerated cellulose in the form of a film is as follows. Thus, when the polymer is water-soluble, it is dissolved into water to obtain an aqueous solution. When the polymer is water-insoluble, it is made into emulsion by the use of an emulsifier to obtain an aqueous dispersion or dissolved into an organic solvent to obtain a solution. Then, the solution or dispersion is impregnated into fiber by the method of spraying, coating or immersion. Then the water or organic solvent is evaporated by means of a hot air dryer or the like, whereby the polymer is attached to the surface of regenerated cellulose fiber in the form of a film.

The amount of water which can be beforehand let exist in the regenerated cellulose fiber is 5% by weight or more and preferably 12% by weight or more based on the absolute dry weight of fiber.

In this invention the effect of treatment with liquid ammonia can be controlled by varying the amount of water in fiber. However, if the amount of water in regenerated cellulose fiber is less than 5% by weight based on the absolute dry weight of fiber, the effect of treatment with liquid ammonia cannot be sufficient or a sufficient effect can be achieved only after so long a period of time as impractical. In order to achieve a sufficient effect without consuming so long a period of time, it is necessary that the fiber beforehand contains 5% by weight or more and preferably 12% by weight or more of water based on the absolute dry weight of fiber. In FIGS. 1, 2, 3 and 4, there are shown relations between the dimensional stability of fiber to water expressed in terms of shrinkage percentage and the period of time during which the fiber is impregnated with liquid ammonia at various moisture contents of regenerated cellulose.

Figure 2:
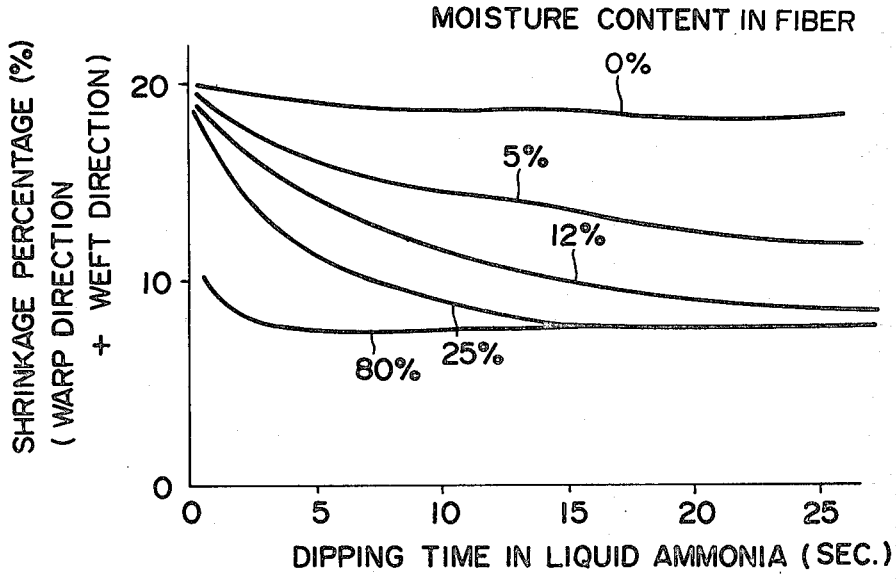
Figure 3:
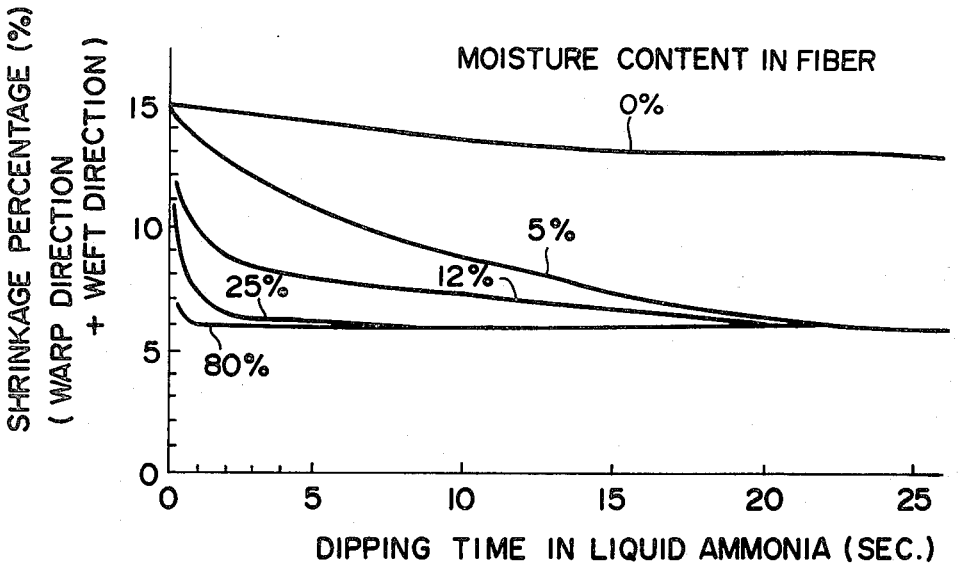
Figure 4:
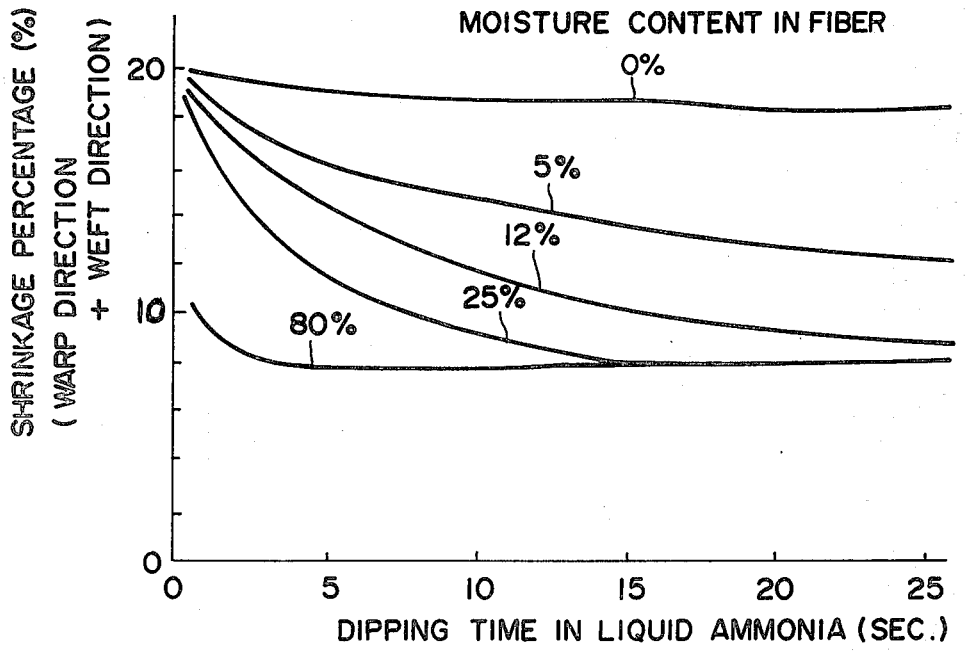

FIGS. 1 and 2 show the cases where the fiber has been surface-treated, while FIGS. 3 and 4 show the cases where fiber has not been surface-treated. Further, FIGS. 1 and 3 show the cases where a textile composed of cuprammonium rayon fiber is used, while FIGS. 2 and 4 show the cases where a textile composed of viscose rayon is used. Ordinates in the drawings express the sum of shrinkage percentage of textile in the warp direction and that in the weft direction (%), while abscissas express the period of time of immersion in liquid ammonia (seconds). Moisture contents (%) in the tested textile were 0%, 5%, 12%, 25% and 80%, successively from up to down.

As is apparent from FIGS. 1 and 3, the effect of liquid ammonia treatment for decreasing shrinkage percentage of textile composed of cuprammonium rayon varies with the amount of water which can be beforehand let exist in fiber. Further, the period of time of treatment necessary for sufficiently lowering shrinkage percentage (the period of time for impregnating fiber with liquid ammonia) also varies depending on the amount of water in fiber. If the moisture content of fiber is less than 5% by weight based on the absolute dry weight of fiber, the period of time of the treatment necessary for sufficiently lowering shrinkage percentage of regenerated cellulose fiber is as long as several hundred seconds. A treatment for such long a period of time is impractical industrially. If the moisture content of fiber is not less than 5% by weight and less than 12% by weight, the period of time necessary for sufficiently lowering shrinkage percentage of fiber is about 30 seconds or less. A treating time of about 30 seconds is still somewhat too long from the viewpoint of practicability, but it can be employed for commercial production. If the moisture content of fiber is 12% by weight or more based on the absolute dry weight of fiber, shrinkage percentage of fiber can be decreased to one half in a treating time of about 10 seconds or less. Thus, a preferable decrease in shrinkage percentage can be achieved in a practically preferable treating time. If the moisture content of fiber is 25% by weight or more based on the absolute dry weight of fiber, a sufficient decrease in shrinkage percentage can be achieved in a treating time of about 1 second, so that such a condition is quite effective when a short treating time is required practically.

In FIGS. 2 and 4, there are shown the relations between the decrease in shrinkage percentage and the period of time during which fiber is impregnated with liquid ammonia (the treating time) at various moisture contents of fiber. As is apparent from those Figures, the treating time necessary for sufficiently decreasing the shrinkage percentage of regenerated cellulose fiber (the period of time during which the fiber is impregnated with liquid ammonia) is as long as several hundred seconds, when the moisture content of fiber is less than 5% by weight based on the absolute dry weight of the fiber. A treatment requiring such long a period of time is industrially impractical. If the moisture content of fiber is not less than 5% by weight and less than 12% by weight based on the absolute dry weight of the fiber, the treating time necessary for sufficiently decreasing shrinkage percentage of fiber is about 15 seconds to about 30 seconds. Though a treating time of about 30 seconds is somewhat too long from the practical point of view, it can be employed for commercial production. If the moisture content of fiber is 12% by weight or more based on the absolute dry weight of the fiber, the shrinkage percentage can be decreased to one half in a treating time of about 15 seconds or less, which is easy to employ practically, and a preferable decrease in shrinkage percentage can be achieved in such treating time. If the moisture content of fiber is 80% by weight based on the absolute dry weight of fiber, a sufficient decrease in shrinkage percentage can be achieved in a treating time of about 1 second, and such a condition is quite effective when a short treating time is required practically.

From FIGS. 1, 2, 3 and 4, the effect of liquid ammonia upon the improvement of the dimensional stability of regenerated cellulose fiber to water and the influence of the moisture content in fiber upon such an effect of liquid ammonia will become apparent.

Essentiality of this invention consists in that, in a process for impregnating a regenerated cellulose fiber with liquid ammonia and thereby treating the fiber for the purpose of improving the dimensional stability of the regenerated cellulose fiber to water, the effect of the treatment can be enhanced by beforehand letting the fiber contain water. Accordingly, to control the moisture content of fiber in a definite range has an important meaning, and this invention is not limited by any of the method of letting the fiber contain water, the method of impregnating the fiber with liquid ammonia, the purity of liquid ammonia, the temperature of liquid ammonia, the period of time of impregnation in liquid ammonia, the method of removing ammonia from fiber, the tension applied to fiber during impregnating the fiber with liquid ammonia and the extent of said tension. Whatever such methods are, a regenerated cellulose fiber treated with liquid ammonia after previous adjustment of the moisture content to a definite amount or more obviously gives a product more excellent in dimensional stability to water than a regenerated cellulose fiber treated with liquid ammonia after previous adjustment of the moisture content to a value less than said definite moisture content.

As the method for letting regenerated cellulose fiber contain water, there can be referred to a method of allowing a fiber to stand in an atmosphere giving a definite moisture content of fiber, a method of spraying water to fiber, a method of blowing steam to fiber, a method of contacting fiber with a water-containing belt-formed material, a method of coating fiber with water, a method of immersing fiber in a water-containing bath, and a method which comprises, after any one of the abovementioned methods, partially removing the water from fiber to adjust the moisture content of the fiber to a definite value. Any of these methods may be employed in this invention.

In addition, the above-mentioned two necessary conditions of this invention, namely "to attach a liquid not readily soluble in liquid ammonia or a film-formable substance to the surface of regenerated cellulose fiber" and "to let regenerated cellulose fiber contain water" must have been satisfied before impregnating the regenerated cellulose fiber with liquid ammonia. However, the order in which these two necessary treatments are applied to regenerated cellulose fiber, the methods of these two treatments and the conditions of these two treatments may be arbitrarily selected, so far as they are in the scopes mentioned above.

For example, it may be a process which comprises letting a fiber contain water and then attaching a liquid not readily soluble in liquid ammonia to the fiber, or a process which comprises attaching a liquid not readily soluble in liquid ammonia to regenerated cellulose fiber and then letting the fiber contain water, or a process which comprises attaching a film-formable substance to the surface of regenerated cellulose fiber and then letting the fiber contain water, or a process which comprises applying an aqueous solution or aqueous dispersion of a film-formable substance to regenerated cellulose fiber and then drying the fiber so as to leave a necessary amount of water in the fiber.

As the method for impregnating liquid ammonia into fiber, there can be referred to a method of dipping the fiber in a liquid ammonia bath, a method of spraying or showering liquid ammonia to the fiber, a method of coating liquid ammonia on the fiber, a method of contacting the fiber with a belt-formed material containing liquid ammonia, and so on, any of which may be employed in this invention.

The temperature of liquid ammonia which fiber is to be impregnated is usually not higher than −33.4° C. and not lower than −77° C. under a pressure of about 1 atmosphere. Under a pressure lower or higher than 1 atmosphere, the temperature of liquid ammonia may be a temperature not higher than its boiling point under the applied pressure and not lower than its freezing point. The amount of liquid ammonia to be impregnated into fiber is 40% by weight or more and preferably 60% by weight or more based on the absolute dry weight of the fiber. The liquid ammonia may be diluted with other substances such as water, an organic solvent (alcohols, ketones, amines and other substances miscible with liquid ammonia), inorganic and organic salts (ammonium salts, rhodan salts, halogenides, nitrates and other substances miscible with liquid ammonia) or the like, so far as the use of such a diluent does not disturb the effect of liquid ammonia in this invention. The amount of said diluent is 0–50% by weight. After the dilution, the concentration of liquid ammonia should be 50% by weight or more and preferably 60% by weight or more.

In order to remove the liquid ammonia impregnated into regenerated cellulose fiber from the fiber, it is preferred to heat the fiber to a temperature not lower than the boiling point of liquid ammonia. Though liquid ammonia slowly vaporizes and leaves the fiber even at a temperature lower than its boiling point, employment of a temperature not lower than boiling point makes the removal more easy and more certain. The boiling point of liquid ammonia is usually −33.4° C. at 1 atmosphere. Under a pressure lower or higher than 1 atmosphere, it is preferred to heat the fiber to a temperature higher than the boiling point at the applied pressure. Further, heating of the fiber to a higher temperature enables to remove the ammonia from fiber more rapidly. However, if the temperature of heating exceeds 200° C., yellowing and embrittlement of fiber take place. Therefore, in cases where yellowing and embrittlement of fiber are undesirable, it is preferred to employ a temperature not exceeding 200° C. The period of time of the heating of fiber should be changed depending on the temperature of heating, as well as depending on the form of fiber. Further it should also be changed depending on the method of heating. As the method of heating, the use of a pin tenter type apparatus, the method of drum heating (typical example of contact heating), a method of dipping a fiber impregnated with liquid ammonia in a liquid substance and heating it in such a state, a method of heating fiber by means of thermal rays, a method of heating fiber by means of microwave, and the like can be referred to, any of which may be employed in this invention so far as the effect of this invention is not disturbed. The period of time of heating cannot be limited to a specified range, because it varies depending on the method of heating, the temperature of heating and the form of fiber to be heated. At any rate, it may be a period not shorter than the period necessary for removing ammonia from fiber.

Further, the dimension of fiber is not particularly fixed in the period of impregnating the fiber with liquid ammonia and in the period of removing liquid ammonia from fiber. More specifically, the fiber may be in a more shrinked state as compared with the dimension before impregnation with liquid ammonia (hereinafter, referred to as "original dimension") or it may be in a more extended state as compared with the original dimension. Though dimension of fiber cannot be specifically mentioned because it may be dependent also on the form of fiber, the state of things will be as follows, for a mere example. Thus, in cuprammonium rayon filament yarn, the length of filament yarn may be contracted to an extent of at most about 10% or extended to an extent of at most about 15% as compared with the original dimension, when it is impregnated in liquid ammonia or when the ammonia is removed from it. At any rate, the effect of the water previously let exist in fiber is not decreased depending on the extent of tension or relaxation applied to the fiber.

The regenerated cellulose fiber obtained by this invention may be subjected to the conventional after-treatments of regenerated cellulose fiber (for example, resin-treatment, softening treatment and the like) at will, and the effect of this invention is not deteriorated by these after-treatments. As compared with usual regenerated cellulose fibers not subjected to the treatment of this invention, the regenerated cellulose fiber obtained by this invention can be markedly more improved in shrink-resistance, crease-resistance and other performances after treatment with resin-treating agent, and it can be said that this invention rather promotes the effect of resin-treatment. For example, if shrink-resistance, crease-resistance and flexing abrasion resistance of a product obtained by resin-treating a textile of usual regenerated cellulose fiber according to the conventional recipe are expressed by 100, 100 and 100, respectively, shrink-resistance, crease-resistance and flexing abrasion resistance of a product obtained by subjecting the same textile as above to the treatment of this invention and then resin-treating it with about 25–75 parts of the same resin treating agent as used above are about 100, about 100 and about 120–200. Thus, when a subsequent resin-treatment is carried out, a product to which the treatment of this invention has been applied gives a fiber more excellent in performances than a product to which the treatment of this invention has not been applied.

The term "absolute dry weight of fiber" used in this specification means the weight of fiber which has been dried in a hot air kept at a temperature of 105° ±2° C. until it reaches a constant weight according to the method mentioned in JIS L-1015.

[Preparation of Test Samples]

In this invention, fibers and cloths were left to stand in an atmosphere having a temperature of 20° C. and a relative humidity of 65% for 48 hours or more for moisture control before measuring their properties, and then used as test samples.

[Dimensional Stability to Water]

Dimensional stability to water is expressed by shrinkage percentage.

A textile which had been treated with liquid ammonia and then made free from ammonia was immersed in hot water at 80° C. and stirred gently for 30 minutes. Then, it was dehydrated by means of a centrifugal dehydrating machine, horizontally placed on a platy bed at room temperature (about 20° C.) without tension, and dried. The dimensional change of the textile in dryness, before and after this hot water treatment, was taken as "shrinkage percentage". Shrinkage percentage is defined as follows:

$$\text{Shrinkage percentage (\%)} = \left(\frac{A-a}{A} + \frac{B-b}{B}\right) - 100$$

where

1. A is dimension, in the warp direction, of textile after removal of ammonia and B is its dimension in weft direction,
2. a is dimension, in the warp direction, of the textile which has been treated with hot water and dried, and b is its dimension in weft direction.

[Softness]

It was evaluated by the bending resistance test of JIS L-1079A (cantilever method) and expressed as bending resistance. The bending resistance herein mentioned is a means value of bending resistances in warp and weft direction.

[Tear strength]

It was measured according to JIS L-1079C. The tear strength herein mentioned is a mean value of tear strengths in warp and weft directions.

This invention will be illustrated more concretely with reference to the following examples. This invention is not limited by these examples.

EXAMPLE 1

Polyvinyl alcohol (degree of saponification 60%, degree of polymerization 1,000) was used as a film-formable water-soluble polymer, and a polyacrylic ester (molecular weight 150,000, W/O type emulsion) was used as a water-dispersible polymer. They were separately attached to a plain weave fabric of which warp and weft were both composed of 75 d/36 f cuprammonium rayon filament yarns (warp density 120/inch, weft density 90/inch). The attachement was carried out by dipping the cloth into aqueous solution or aqueous dispersion, squeezing it and then drying it. The amounts of the attached polymers are shown in Table 1. Then the textile was placed in a room kept at a temperature of 20° C. and a relative humidity of about 70% to let the fiber contain 13% of moisture based on the absolute dry weight of the fiber. Then the textile was immersed in liquid ammonia at −40° C. for 20 seconds, drawn up and subsequently contacted with a hot plate having a surface temperature of 130° C. for 60 seconds to remove ammonia from the textile. Then, the polyvinyl alcohol and the polyacrylic ester were removed from the surface of the textile by a process according to the usual desizing and scouring processes. The dimensions of the textile were fixed so that the original demensions of the textile were maintained throughout the period from the step of impregnating the textile with liquid ammonia to the step of removing ammonia from the textile. In the comparable example, the same textile as above was directly (without attaching polymers to the surface of textile) treated with liquid ammonia in the same manner as above.

The results are shown in Table 1.

TABLE I

| | Film-formable polymer | Amount of polymer attached (%) | Shrinkage percentage (%) | Bending resistance (cm) | Tear strength (g) |
|---|---|---|---|---|---|
| 1 | Polyvinyl alcohol | 0.1 | 6.5 | 6.3 | 750 |
| 2 | | 0.5 | 6.5 | 4.5 | 1,000 |
| 3 | | 5.0 | 6.0 | 3.6 | 1,150 |
| 4 | | 10.0 | 6.0 | 3.5 | 1,100 |
| 5 | | 15.0 | 8.0 | 3.5 | 1,150 |
| 6 | Polyacrylic ester | 0.1 | 6.1 | 6.2 | 760 |
| 7 | | 0.5 | 6.0 | 4.5 | 1,000 |
| 8 | | 5.0 | 6.0 | 3.3 | 1,100 |
| 9 | | 10.0 | 6.5 | 3.5 | 1,100 |
| 10 | | 15.0 | 8.3 | 3.5 | 1,150 |
| 11 | Comparative Example | — | 6.5 | 7.1 | 700 |
| 12 | Untreated cloth | — | 16.0 | 3.5 | 1,250 |

Said "process according to usual desizing and scouring processes" was as follows. Thus, 2 g/liter of surfactant and 2 g/liter of sodium carbonate were dissolved into hot water at 80° C., in which a textile was immersed and stirred gently. After 30 minutes, the textile was taken out, washed with water, dehydrated and then dried by placing it on horizontal bed without tension in a room kept at about 20° C. In this example, the desizing and scouring were carried out for the measurement of shrinkage percentage.

EXAMPLE 2

As the liquid to be adsorbed on regenerated cellulose fiber, hexane, castor oil and polyoxyethylene alkyl ether were used. The liquid was attached to a textile of cuprammonium rayon filament yarn (warp: 75 d/36 f filament yarn; weft: 75 d/36 f filament yarn; warp density 120/inch; weft density 90/inch). Then, saturated steam (100° C.) was blown to the texile to adjust the moisture content of the textile to about 20%. (The amount of the liquid attached to the textile is shown in Table II.)

Then the textile was immersed in liquid ammonia at −50° C. After 20 seconds, it was drawn up from the liquid ammonia, immediately treated with a pin tenter, and dried in hot air at 180° C. to remove ammonia from the textile. Hexane vaporized simultaneously with the ammonia. Textiles to which castor oil or polyoxyethylene alkyl ether was attached were desized and scoured in the same manner as in Example 1, after which shrinkage percentage was measured.

TABLE II

| | Liquid not readily soluble in liquid ammonia and adsorbable on fiber | Amount of the liquid attached to fiber (%) | Shrinkage percentage (%) | Bending resistance (cm) | Tear strength (g) |
|---|---|---|---|---|---|
| 1 | Hexane | 2 | 6.7 | 6.4 | 790 |
| 2 | | 5 | 6.8 | 3.8 | 1,000 |
| 3 | | 10 | 6.5 | 3.4 | 1,100 |
| 4 | | 15 | 7.9 | 3.4 | 1,100 |
| 5 | Castor oil | 2 | 6.5 | 6.3 | 800 |
| 6 | | 5 | 6.5 | 4.0 | 1,000 |
| 7 | | 10 | 6.7 | 3.3 | 1,150 |
| 8 | | 15 | 8.0 | 3.4 | 1,100 |
| 9 | Polyoxyethylene alkyl ether | 2 | 6.6 | 6.5 | 810 |
| 10 | | 5 | 6.6 | 3.9 | 980 |
| 11 | | 10 | 6.8 | 3.5 | 1,200 |
| 12 | | 15 | 8.1 | 3.4 | 1,100 |
| 13 | Comparative Example | — | 6.5 | 7.1 | 700 |
| 14 | Untreated cloth | — | 16.0 | 3.5 | 1,250 |

EXAMPLE 3

A textile composed of viscose rayon (warp: 75 d/26 f; weft: 120 d/50 f; warp density 105/inch; weft density 70/inch) was treated in the same manner as in Example 1. The results are shown in Table III.

TABLE III

| | Film-formable polymer | Amount of polymer attached (%) | Shrinkage percentage (%) | Bending resistance (cm) | Tear strength (g) |
|---|---|---|---|---|---|
| 1 | Polyvinyl alcohol | 0.1 | 8.1 | 4.7 | 850 |
| 2 | | 0.8 | 8.2 | 4.2 | 1,050 |
| 3 | | 6.0 | 8.0 | 3.8 | 1,000 |
| 4 | | 10.0 | 8.3 | 3.7 | 1,100 |
| 5 | | 15.0 | 12.0 | 3.6 | 1,100 |
| 6 | Polyacrylic ester | 0.1 | 8.0 | 4.5 | 840 |
| 7 | | 0.8 | 7.9 | 3.9 | 900 |
| 8 | | 6.0 | 8.0 | 3.5 | 1,100 |
| 9 | | 10.0 | 8.5 | 3.4 | 1,050 |
| 10 | | 15.0 | 12.5 | 3.5 | 1,100 |
| 11 | Comparative Example | — | 8.0 | 5.0 | 850 |
| 12 | Untreated cloth | — | 20.0 | 3.6 | 1,100 |

EXAMPLE 4

As film-formable water-soluble polymer, polyvinyl alcohol (degree of saponification: 90%; degree of polymerization: 800) was used. It was attached to a plain cloth of which warp and weft were both composed of 75 d/36 f cuprammonium rayon filament (warp density 120/inch, weft density 90/inch) by immersing the textile in an aqueous solution of the polymer, followed by squeezing and drying it. The amount of the attached polymer was 3% by weight based on the weight of the textile. Then the textile was immersed in a water-containing bath, squeezed and dried to let the textile contain 12% by weight of water based on absolute dry weight of the fiber. On the other hand, a treating solution was prepared by mixing water, ethyl alcohol, ethylenediamine, ammonium rhodanate or ammonium nitrate into liquid ammonia at −36° C. in the predetermined proportions. The textile was immersed in the treating solution at −36° C. for 15 seconds, after which it was drawn up, immediately treated with a pin tenter and heated in hot air at 180° C. to remove ammonia from the textile. Water, ethyl alcohol and ethylenediamine vaporized simultaneously with the ammonia. Ammonium rhodanate and ammonium nitrate were not sublimable, so that they remained in the textile. Subsequently, polyvinyl alcohol, ammonium rhodanate and ammonium nitrate were removed by desizing and scouring the textiles in the same manner as in Example 1. Then, shrinkage percentages were measured.

TABLE IV

| | Film-formable polymer | Amount of polymer attached (%) | Substance mixed into liquid ammonia | Proportion of substance mixed into liquid ammonia (%) | Shrinkage percentage (%) | Bending resistance (cm) | Tear strength (g) |
|---|---|---|---|---|---|---|---|
| 1 | Polyvinyl alcohol | 3.0 | Water | 0 | 6.0 | 3.8 | 1,150 |
| 2 | | | | 30 | 6.0 | 3.7 | 1,140 |
| 3 | | | | 60 | 12.0 | 3.6 | 1,140 |
| 4 | | | Ethyl alcohol | 30 | 6.2 | 3.7 | 1,130 |
| 5 | | | | 60 | 12.5 | 3.6 | 1,130 |
| 6 | | | Ethylenediamine | 30 | 6.0 | 3.7 | 1,140 |
| 7 | | | | 60 | 12.4 | 3.6 | 1,140 |
| 8 | | | Ammonium rhodanate | 30 | 6.0 | 3.7 | 1,130 |
| 9 | | | | 60 | 12.8 | 3.6 | 1,130 |
| 10 | | | Ammonium nitrate | 30 | 6.0 | 3.8 | 1,130 |
| 11 | | | | 60 | 13.0 | 3.7 | 1,130 |
| 12 | Comparative Example | — | — | — | 6.5 | 2.1 | 700 |
| 13 | Untreated cloth | — | — | — | 16.0 | 3.5 | 1,250 |

EXAMPLE 5

Cuprammonium rayon filament yarns (120 denier, 36 filaments) having a moisture content of 0%, 5%, 12% and 30%, based on the absolute dry weight of yarns, were immersed in liquid ammonia at −40° C. Then, they were contacted with heating rolls kept at 100° C. for 30 seconds to remove the ammonia from the yarns. Throughout the treatment, the lengths of yarns were kept at the same dimension as that before treatment. The results are shown in Table V.

TABLE V

| | Moisture content of yarn (%) | Period of immersion in liquid ammonia (seconds) | Shrinkage percentage in hot water (%) |
|---|---|---|---|
| Untreated yarn | — | — | 3.5 |

TABLE V-continued

| | Moisture content of yarn (%) | Period of immersion in liquid ammonia (seconds) | Shrinkage percentage in hot water (%) |
|---|---|---|---|
| Yarns treated with liquid ammonia | 0 | 1 | 3.5 |
| | | 10 | 3.3 |
| | | 20 | 3.2 |
| | 5 | 1 | 3.0 |
| | | 10 | 2.2 |
| | | 20 | 1.8 |
| | 12 | 1 | 2.1 |
| | | 10 | 0.7 |
| | | 20 | 0.5 |
| | 30 | 1 | 0.8 |
| | | 10 | 0.5 |
| | | 20 | 0.5 |

Note:
Shrinkage percent in hot water:
A yarn was immersed in lukewarm water (40° C.) for 30 minutes and then dried. Shrinkage of the yarn, based on the yarn before the treatment, was expressed by percentage.

EXAMPLE 6

Textiles (taffetas, the same as in Example 2) composed of 75 denier cuprammonium rayon filament yarns were conditioned in a constant temperature-constant humidity chamber to obtain textiles having a moisture content of 0%, 5%, 12%, 25% and 80%, based on the absolute dry weight of the textiles. They were immersed in a liquid ammonia bath kept at −38° C., and then drawn up and immediately dried in hot air having a temperature of 120° C. to remove ammonia from the textiles. Then, they were immersed in hot water at 80° C. and their dimensional stabilities (shrinkage percentages) were measured. The results are shown in FIG. 3. As apparent from FIG. 3, there was a great difference in shrinkage percentage between the textiles which beforehand contained water in fiber (those having a moisture content of 5%, 12%, 25% and 80%) and the textile having a moisture content of 0%.

Shrinkage percentage: After removing ammonia, the textile was immersed in hot water kept at 80° C. and gently stirred for 30 minutes. Then the water adhering to the surface of fiber was removed by means of a centrifugal machine, and the textile was dried by horizontally placing it at room temperature (about 20° C.) without tension. The dimensional change of textile in dryness before and after the treatment with hot water was taken as "shrinkage percentage".

Shrinkage percentage is defined by the following equation:

$$\text{Shrinkage percentage (\%)} = \left(\frac{A-a}{A} + \frac{B-b}{B}\right) \times 100$$

where

A is dimension, in the warp direction, of the textile after removal of ammonia and before treatment with hot water, B is dimension, in the weft direction, of the same textile as above, a is dimension, in the warp direction, of the textile after being treated with hot water and dried, and b is dimension, in the weft direction, of the same textile as above.

Other properties are shown in Table VI.

TABLE VI

| | Moisture content in textile (%) | Period of immersion in liquid ammonia (seconds) | Bending resistance (cm) | Tear strength (g) |
|---|---|---|---|---|
| 1 | 0 | 30 | 6.5 | 780 |
| 2 | 5 | 20 | 7.1 | 750 |
| 3 | 12 | 10 | 7.3 | 750 |
| 4 | 25 | 10 | 7.8 | 700 |
| 5 | 80 | 10 | 9.0 | 600 |
| 6 | Untreated cloth | — | 3.5 | 1,300 |

EXAMPLE 7

A textile composed of viscose rayon filament yarns (taffeta, warp 120 denier, weft 75 denier, warp density 105/inch, weft density 70/inch) was treated under the same conditions as in Example 2. The results are shown in FIG. 4.

Similarly to Example 6, moisture content obviously has a great effect. Other properties are shown in Table VII.

TABLE VII

| | Moisture content in textile (%) | Period of immersion in liquid ammonia (seconds) | Bending resistance (cm) | Tear strength (g) |
|---|---|---|---|---|
| 1 | 0 | 30 | 4.5 | 1,000 |
| 2 | 5 | 25 | 4.7 | 930 |
| 3 | 12 | 20 | 4.7 | 900 |
| 4 | 25 | 15 | 5.0 | 850 |
| 5 | 80 | 10 | 5.5 | 800 |
| 6 | Untreated cloth | — | 3.7 | 1,200 |

EXAMPLE 8

Cuprammonium rayon filament yarns (120 denier, 36 filaments) whose moisture content had been adjusted to 0% and 15% based on the absolute dry weight of the yarn, were immersed in liquid ammonia kept at −50° C. for 30 seconds and then contacted with hot metallic rolls kept at 150° C. for 20 seconds to remove ammonia from the yarns. Tensions applied to the yarns in the course of immersion in liquid ammonia and removal of ammonia (both steps are collectively referred to as "treatment step") are shown in Table VIII. The results are shown in Table VIII. It is apparent from Table VIII that the yarns having a moisture content of 15% showed a low shrinkage percentage in hot water (its definition is the same as in Example 1) even if a high tension was applied in the course of the treatment.

TABLE VIII

| | Moisture content in yarn (%) | Tension at the time of treatment (g) | Shrinkage percentage in hot water (%) |
|---|---|---|---|
| Untreated yarn | — | — | 3.5 |
| Yarns treated with liquid ammonia | 15 | 0 | 0.6 |
| | | 5 | 0.6 |
| | | 10 | 0.8 |
| | | 50 | 1.5 |
| | 0 | 10 | 4.0 |
| | | 50 | 5.5 |

EXAMPLE 9

The same textile as in Example 2 was adjusted to a moisture content of 15% and fixed on a frame so as to keep the original dimension. Liquid ammonia was sprayed to the textile to attach ammonia to the textile in an amount of 20%, 40%, 60% or 100% based on the absolute dry weight of the textile. After placing the textile in the air (20° C.) for 15 seconds, it was placed in an air having a temperature of 120° C. to remove ammonia from the textile. Then it was taken off from the frame, and its shrinkage percentage was measured by the method mentioned in the body of the specification. The results are shown in Table IX. To the textile used in this Example, 3% of polyvinyl alcohol had been attached previously.

TABLE IX

| | Amount of ammonia attached (%) | Shrinkage percentage (%) | Bending resistance (cm) | Tear strength (g) |
|---|---|---|---|---|
| 1 | 20 | 15.3 | 3.7 | 1,200 |
| 2 | 40 | 14.5 | 3.5 | 1,200 |
| 3 | 60 | 6.5 | 3.3 | 1,250 |
| 4 | 100 | 6.8 | 3.8 | 1,150 |
| 5 | Untreated cloth | 16.0 | 3.5 | 1,250 |

EXAMPLE 10

To the surface of the same textile as in Example 1, were attached 3% by weight, based on the weight of the textile, of polyvinyl alcohol and 13% of water. The textile was fixed on a pin frame so as to keep the original dimension and was immersed in liquid ammonia at −35° C. for 15 seconds. Then, ammonia in the textile was removed with hot air at 150° C. Thereafter, in the same manner as in Example 1, polyvinyl alcohol was removed from the textile. After drying, the textile was subjected to a resin-treatment with N,N'-dimethyloldihyroxyethyleneurea (referred to as "treating agent", hereinafter). In this treatment, an aqueous solution of treating agent was used so that the amount of attached agent, based on the weight of the textile, may be 6% and 12%. Further, 20%, based on the weight of the textile, of magnesium chloride was attached together with the treating agent to the textile as catalyst for accelerating the reaction between the treating agent and the textile. Then, after drying in a hot-air dryer at 100° C. for 3 minutes, the textile was heat-treated in the same dryer as above at 160° C. for 3 minutes. All operations in the removing of polyvinyl alcohol, the drying, and the drying and heat-treatment in resin-treatment were carried out so as to keep the original dimension of the textile. The properties of the textile obtained were measured. Results thereof are shown in Table X below.

TABLE X

| | | Treatment with liquid ammonia | Amount of treating agent attached (%) | Shrinkage resistance (warp + weft) (%) | Crease resistance (warp + weft) (%) | Flexing abrasion resistance (warp + weft) (times) |
|---|---|---|---|---|---|---|
| 1 | Examples | treated | 1.0 | 5.5 | 100 | 5200 |
| 2 | acccording to | | 1.8 | 4.5 | 110 | 5000 |
| 3 | present | | 3.6 | 4.3 | 115 | 4250 |
| 4 | invention | | 5.4 | 4.1 | 120 | 3750 |
| 5 | Comparative Example | — | 7 | 4.5 | 115 | 2500 |
| 6 | Original | — | 0 | 14.0 | 90 | 5300 |

(Note)
Flexing abrasion resistance:
Sum of flexing abrasion resistance in warp direction and that in weft direction obtained by measuring according to JIS-L-1079, Measurement of Abrasion Resistance A-2 method (flexing method).
Crease resistance:
Sum of crease resistance in warp direction and that in weft direction obtained by measuring according to JIS-L-1079, Measurement of Crease Resistance A method (wire method).
Shrinkage resistance:
Sum of shrinkage resistance in warp direction and that in weft direction obtained by measuring according to JIS-L-1042, Measurement of washing shrinke E method (washing machine method).

What is claimed is:

1. A process for producing a regenerated cellulose fiber having a good hand and a good shrink resistance comprising applying a liquid not readily soluble in liquid ammonia and adsorbable on regenerated cellulose fiber to the surface of regenerated cellulose fiber or attaching a polymer to the surface of regenerated cellulose fiber in the form of a film, adjusting the moisture content of said regenerated cellulose fiber to 5% or more based on the absolute dry weight of said fiber, thereafter contacting said regenerated cellulose fiber with liquid ammonia, and subsequently removing the ammonia from the regenerated cellulose fiber.

2. A process according to claim 1, wherein said liquid adsorbable on regenerated cellulose fiber is at least one substance selected from the group consisting of aliphatic hydrocarbons, aromatic hydrocarbons, fatty oils and surfactants.

3. A process according to claim 1 or claim 2, wherein the amount of said liquid adsorbable on regenerated cellulose fiber is not less than 5% and not greater than 15% based on the absolute dry weight of regenerated cellulose fiber.

4. A process according to claim 1, wherein said polymer to be applied to the surface of regenerated cellulose fiber in the form of a film is a water-soluble polymer.

5. A process according to claim 1, wherein said polymer to be applied to the surface of regenerated cellulose fiber in the form of a film is a polymer which is not readily soluble in water or insoluble in water and emulsifiable or dispersible in water.

6. A process according to claim 1, claim 4 or claim 5, wherein said polymer to be applied to the surface of regenerated cellulose fiber in the form of a film has a molecular weight of 10,000 or higher.

7. A process according to claim 1, claim 4, claim 5 or claim 6, wherein the amount of said polymer to be applied to the surface of regenerated cellulose fiber in the form of a film is not less than 0.5% by weight and not greater than 10% by weight based on the absolute dry weight of the regenerated cellulose fiber.

8. A process according to any of claims 1 to claim 7, wherein the amount of water let exist in regenerated cellulose fiber is not less than 5% and less than 12% based on the absolute dry weight of the regenerated cellulose fiber.

9. A process according to any of claims 1 to claim 7, wherein the amount of water let exist in regenerated cellulose fiber is 12% or more based on the absolute dry weight of the regenerated cellulose fiber.

10. A process according to any of claims 1 to claim 9, wherein the amount of said liquid ammonia with which regenerated cellulose fiber is impregnated is 60% or more based on the absolute dry weight of the regenerated cellulose fiber.

11. A process according to any of claims 1 to claim 10, wherein said liquid ammonia with which regenerated cellulose fiber is impregnated contains 0–50% by weight of a substance miscible with liquid ammonia.

12. A process according to any of claims 1 to claim 11, wherein said regenerated cellulose fiber is a cuprammonium rayon, 13. A process according to any of claims 1 to claim 11, wherein said regenerated cellulose fiber is a viscose rayon.

14. A process according to claim 1, wherein the contact of the regenerated cellulose fiber with the liquid ammonia is for at least about 5 seconds.

* * * * *